US007082868B2

(12) United States Patent
Reichman

(10) Patent No.: US 7,082,868 B2
(45) Date of Patent: Aug. 1, 2006

(54) LIGHTWEIGHT ARMOR WITH REPEAT HIT AND HIGH ENERGY ABSORPTION CAPABILITIES

(75) Inventor: Steven H. Reichman, Pittsburgh, PA (US)

(73) Assignee: ATI Properties, Inc., Albany, OR (US)

( * ) Notice: Subject to any disclaimer, the term of this patent is extended or adjusted under 35 U.S.C. 154(b) by 381 days.

(21) Appl. No.: 09/809,548

(22) Filed: Mar. 15, 2001

(65) Prior Publication Data

US 2003/0159575 A1 Aug. 28, 2003

(51) Int. Cl.
*F41H 5/04* (2006.01)

(52) U.S. Cl. ..... 89/36.02; 89/36.08

(58) Field of Classification Search ..... 89/36.01, 89/36.02, 36.08
See application file for complete search history.

(56) References Cited

U.S. PATENT DOCUMENTS

| | | | | |
|---|---|---|---|---|
| 4,207,381 | A * | 6/1980 | Aisaka et al. | 428/619 |
| 4,518,444 | A * | 5/1985 | Albrecht et al. | 148/402 |
| 4,841,838 | A * | 6/1989 | Scully et al. | 89/36.08 |
| 4,879,165 | A | 11/1989 | Smith | 428/212 |
| 4,987,033 | A | 1/1991 | Abkowitz et al. | 428/469 |
| 5,254,383 | A | 10/1993 | Harpell et al. | 428/76 |
| 5,293,806 | A | 3/1994 | Gonzalez | 89/36.03 |
| 5,332,545 | A | 7/1994 | Love | 420/420 |
| 5,370,034 | A * | 12/1994 | Turner et al. | 89/36.02 |
| 5,376,426 | A | 12/1994 | Harpell et al. | 428/109 |
| 5,431,506 | A | 7/1995 | Masunaga | 403/271 |
| 5,435,226 | A | 7/1995 | McQuilkin | 89/36.02 |
| 5,579,988 | A | 12/1996 | Schutz et al. | 228/190 |
| 5,614,305 | A * | 3/1997 | Paine et al. | 428/301.1 |
| 5,654,518 | A * | 8/1997 | Dobbs | 89/36.02 |
| 5,687,995 | A * | 11/1997 | Mori et al. | 285/381.2 |
| 5,750,272 | A * | 5/1998 | Jardine | 428/686 |
| 5,799,238 | A | 8/1998 | Fisher, II et al. | 419/7 |
| 5,861,076 | A | 1/1999 | Adlam et al. | 156/281 |
| 5,882,444 | A | 3/1999 | Flomenblit et al. | 148/510 |
| 5,928,803 | A * | 7/1999 | Yasuda | 374/101 |
| 5,939,213 | A | 8/1999 | Bowden et al. | 428/614 |
| 5,964,770 | A | 10/1999 | Flomenblit et al. | 606/78 |
| 5,980,655 | A | 11/1999 | Kosaka | 148/421 |
| 6,053,993 | A | 4/2000 | Reichman et al. | 148/421 |

(Continued)

FOREIGN PATENT DOCUMENTS

JP 63-115795 * 11/1986

OTHER PUBLICATIONS

Jackson et al., 55-Nitinol—The Alloy with a Memory; NASA Report; 1972.*

(Continued)

*Primary Examiner*—Stephen M. Johnson
(74) *Attorney, Agent, or Firm*—Kirkpatrick & Lockhart Nicholson Graham LLP

(57) ABSTRACT

A lightweight armor with repeat hit capability includes at least one layer of material that absorbs energy upon being impacted by an object through a reversible phase change and/or an elastic strain deformation of at least 5%. Once the energy of the object has been absorbed the layer of material returns to its original shape, thereby resulting in an armor with repeat hit capabilities. The armor may also include additional layers of material constructed of conventional armor materials. A method of manufacturing such an armor is also disclosed.

13 Claims, 2 Drawing Sheets

U.S. PATENT DOCUMENTS

| | | | | |
|---|---|---|---|---|
| 6,135,006 | A | 10/2000 | Strasser et al. | 89/36.05 |
| 6,357,332 | B1 * | 3/2002 | Vecchio | 89/36.02 |
| 6,363,867 | B1 * | 4/2002 | Tsilevich | 109/49.5 |
| 6,406,566 | B1 * | 6/2002 | Ishida et al. | 148/402 |
| 6,547,280 | B1 * | 4/2003 | Ashmead | 280/751 |

OTHER PUBLICATIONS

Buehler et al., 55-Nitinol—Unique Wire Alloy with a Memory; Wire Journal; pp. 41-49; Jun. 1969.*
Webster's Dictionary; 3 pages; copyright 1996.*

* cited by examiner

LIGHTWEIGHT ARMOR WITH REPEAT HIT AND HIGH ENERGY ABSORPTION CAPABILITIES

CROSS REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates generally to structural components, and, specifically, to armors. In particular, the present invention relates to armors including a material that is capable of undergoing at least one of a reversible phase change and/or an elastic strain deformation of at least 5% when an object impacts the armors and transfers sufficient energy to the armors. The present invention is also directed to methods of manufacturing such armors. The armors of the invention find application as, for example, a protective facing material for armored vehicles, such as tanks, helicopters, trucks, and the like.

2. Description of the Invention Background

Historically, armored combat vehicles were protected by heavy metallic armors made from, for example, iron or high alloy steels. As more powerful and sophisticated armor piercing projectiles were developed, armors made from these conventional materials had to be made more resistant to penetration. This was generally achieved by making the armor thicker, which had the disadvantage of making the armor heavier.

In response to the development of sophisticated armor piercing rounds, stronger but lighter materials began to be used. For example, Ti-6Al-4V (nominally 6 weight percent aluminum, 4 weight percent vanadium, balance essentially titanium) has good penetration resistance and, therefore, has become a widely used armor material. This alloy, which is relatively lightweight, absorbs the energy of a projectile by spreading the energy out across its mass, thereby blunting the tip of the projectile and resisting penetration. Military Specification MIL-A-40677 sets forth the military requirements for such armors. Various modifications to the composition of titanium-based armors have been proposed, some of which are taught in U.S. Pat. Nos. 6,053,993, 5,980,655, and 5,332,545.

Recently, conventional lightweight armors, including titanium-base armors, have been thwarted by advanced armor piercing rounds designed to concentrate their energy within a very small area that may melt the armor material. In response, ceramic-based armors have been developed. Ceramics are used in the fabrication of armors because they are lightweight and extremely hard materials. One of the drawbacks with ceramic armors, however, is that they dissipate the energy of the projectile partially by cracking. Therefore, ceramic armors lack repeat hit capability, i.e., they will not resist penetration if hit in the same position multiple times, and they disintegrate if struck by multiple rounds. Attempts have been made to address this problem, one of which is disclosed in U.S. Pat. No. 4,987,033, which teaches an armor that uses a Ti-6Al-4V layer surrounding a ceramic-based core. Nevertheless, while this design provides somewhat improved performance, the ceramic core eventually cracks when struck multiple times, thereby eliminating the armor's effectiveness. Moreover, the cost of ceramic armors may be exorbitant.

Another class of armor design is the so-called reactive armor. Here, the armor includes an explosive material that, when contacted by the projectile, explodes violently. In this design, the outward force of the reactive armor explosion counteracts the force of the incoming projectile, thereby resisting penetration of the armor. Reactive armor designs may also include movable members that may, for example, absorb the energy of the projectile, blunt the projectile, modify the trajectory of the projectile, and/or destroy the projectile. An example of such an armor design is disclosed in U.S. Pat. No. 5,293,806. Reactive armors, however, like ceramic armors, are deficient in that they do not have multi-shot capability, i.e., they do not provide substantial protection against multiple hits occurring in the same region. Once the reactive armor is activated, a second round hitting the armor in the same location is much more likely to penetrate the armor.

Thus, it is desirable to provide a lightweight armor having multi-shot capability that is able to withstand the energy of advanced armor piercing rounds.

SUMMARY OF THE INVENTION

The present invention relates to a structural component, particularly an armor, and a method of manufacturing such armor. In particular, the present invention relates to an armor comprising a first plate or other structure including a metallic material that absorbs energy from an object upon impact by at least one of a reversible phase change and/or an elastic strain deformation of at least 5%. The invention results in a lightweight armor with repeat hit capability. Such energy absorbing materials may include, for example, nickel-titanium alloys, copper-zinc alloys, and copper-aluminum-nickel-manganese alloys.

According to one embodiment of the invention, the armor includes a first plate and the energy absorbing material of the first plate comprises at least one layer of an alloy consisting essentially of 45 up to 55 atomic percent nickel (40–50 wt % nickel), 45 up to 55 atomic percent titanium (50–60 wt % titanium), and incidental impurities. For example, the first plate may comprise two energy absorption layers wherein the composition of one energy absorption layer is manipulated such that it absorbs the energy from an object upon impact by a reversible phase change and the composition of the other energy absorption layer is manipulated so that it absorbs such energy by elastic strain deformation of at least 5%.

The armor of the present invention may also comprise a first plate and a second plate, wherein the second plate comprises a material that is different from the material of the first plate. For example, the second plate may be comprised of any one of several traditional armor materials. Similarly, the armor plate of the present invention may also include a third plate that is disposed opposite to the second plate and is also comprised of a material that is different from the material of the first plate.

The present invention also relates to a method of manufacturing an armor plate. According to the method, a first plate comprising at least one energy absorption layer is provided by conventional techniques. The first plate is then contacted with the second plate, which is also formed by conventional techniques, and then bonded thereto. The contacting surfaces of the first plate and the second plate may be cleaned, such as by grinding and pickling, before they are contacted. The bonding of the first and second plates may be completed by heating the plates and then applying bonding pressure thereto, such as by rolling, hot isostatic pressing (HIP), or explosive bonding, until a metallurgical bond is formed therebetween.

If a third plate is provided, it is also contacted to the first plate and bonded thereto. The third plate is placed opposite the second plate and contacts the first plate. The contacting surfaces of the first plate and the third plate may be cleaned, such as by grinding and pickling, before they are contacted. The third plate may also be bonded to the first plate by heating the plates and then applying pressure thereto, such as by rolling, HIP, or explosive bonding, until a metallurgical bond is formed therebetween.

BRIEF DESCRIPTION OF THE DRAWINGS

The advantages of the present invention may be better understood by reference to the drawings in which.

DETAILED DESCRIPTION OF THE INVENTION

Figure 1:
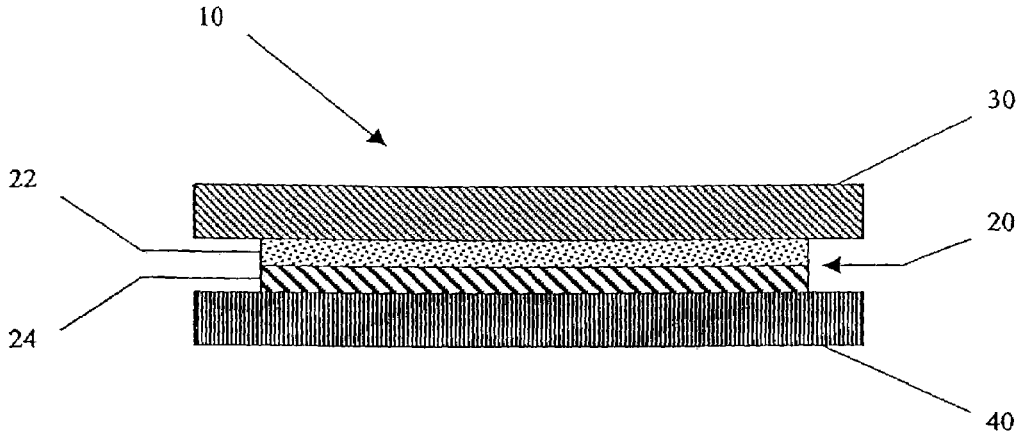
FIG. 1 is a schematic illustration of an embodiment of the lightweight armor of the present invention.

Referring now to FIG. 1, in one form the present invention provides an armor 10 including a material that absorbs energy from an object when the object impacts the armor. The armor 10 may be in the form of a plate or in some other suitable form. The metallic material used in the present invention absorbs the energy through at least one of a reversible phase change and/or elastic (and therefor reversible) deformation. Armors within the present invention that absorb the energy of impact solely by elastic deformation are those wherein the material has elastic strain of at least 5%. The lightweight armor 10 has repeat hit capability, even against advanced armor piercing rounds. In another form, the present invention is directed to a method of manufacturing such an armor constructed according to the present invention.

Armor 10 includes a first layer in the form of a first plate 20. This first plate 20 comprises at least one energy absorbing layer 22 that includes a material that will absorb the energy from an object, such as an armor piercing projectile, that impacts the armor 10. The material included in layer 22 absorbs energy by reversibly changing phase and/or by elastically deforming. The material also may absorb energy by both reversible phase change and elastic deformation mechanisms. In the case where the sole mechanism of energy absorption of layer 22 is elastic deformation, the energy absorbing material is a highly elastic metallic material that will exhibit elastic strain of at least 5%. Materials that absorb energy by these phase change and/or elastic deformation mechanisms include, for example, certain nickel-titanium alloys, copper-zinc alloys, and copper-aluminum-nickel-manganese alloys.

According to one embodiment of the present invention, the first plate 20 comprises an alloy consisting essentially of 45 up to 55 atomic percent nickel (40–50 wt % nickel) and 45 up to 55 atomic percent titanium (50–60 wt % titanium), known to those of ordinary skill as Nitinol. Other elements, such as, for example, Cu, Fe, Cr, Pd and V, may also be present in the Nitinol material as alloying elements in small amounts.

Nitinol is a well-known shape memory alloy (SMA) that is a binary alloy of nickel and titanium and can switch from one shape to another, "memorized" shape upon a temperature change. One way that Nitinol exhibits this characteristic is by undergoing a reversible endothermic phase change when heated to a predetermined temperature. However, by tailoring the composition of this material, it is possible to manipulate the mechanism by which the material absorbs energy from an object upon impact by the object. For example, a Nitinol material that is relatively rich in titanium, i.e., greater than about 51 atomic percent titanium is in a martensitic state or phase at operating temperatures up to 200° C. (212° F.). Upon impact, this shape memory effect (SME) alloy absorbs energy by undergoing a reversible endothermic phase change from the martensitic to the austenitic state. Since austenite is the "remembered" original configuration, the original shape of the plate is restored after the energy from the object has been absorbed and dissipated, thereby resulting in an armor plate 10 with repeat hit capability.

On the other hand, a Nitinol material that is relatively rich in nickel, i.e., less than 50 atomic percent titanium, is in the austenitic state or phase at operating temperatures down to about −50° C. (−58° F.). In this superelastic SME alloy, large elastic strain deformation can absorbs a large amount of energy from an incoming object. These strains may be on the order of 10%. For purposes of the present invention a strain deformation of at least 5% is contemplated. After releasing the stress, the material recovers its initial shape without the additional input of heat or other energy. This also results in an armor 10 with repeat hit capability.

By tailoring the composition of the Nitinol material, it is possible to pre-set the temperature or, in other words, energy input, at which the transformation of the alloy from an austenite phase to a martensite phase will occur. As the atomic percent of nickel in the Nitinol material is increased, the martensitic transformation temperature decreases. For alloys composed of 45 up to 55 atomic percent nickel and 45 up to 55 atomic percent titanium, optionally along with trace impurities, the martensitic transformation temperature can be from around −50° C. up to around 200° C. depending upon the actual elemental composition of the material. Thus, according to the present invention, the armor plate 10 may comprise a material that undergoes a reversible endothermic phase change at a temperature that is predetermined. This may be particularly useful if the normal temperature encountered by the material in service is known. In this case, the temperature at which the phase change occurs may be "preset" to a level higher that the nominal service temperature.

According to another embodiment of the present invention, the first plate 20 may contain a second energy absorption layer 24. According to this embodiment, the composition of the energy absorption layers 22, 24 are manipulated such that one of them, whether it is the first energy absorption layer 22 or the second energy absorption layer 24, comprises a material that absorbs the energy from an incoming round by a reversible phase change, i.e., it is martensitic at operating temperatures of up to 200° C. (212° F.), and the other energy absorption layer comprises a material that absorbs the energy from an incoming round by strain deformation of at least 5%, i.e., it is austenitic at operating temperature down to −50° C. (−58° F.). Such a combination of mechanisms may be incorporated to manage the speed of the transformation.

The present invention may also include a second plate 30 that comprises a different material than the material comprising the first plate 20. This second plate 30 may, for example, comprise any traditional armor materials such as, for example, titanium, gamma phase titanium-aluminum, α titanium alloy (such as, for example, CPTi grades (1–4)), β titanium alloy (such as, for example, Ti(10-2-3) or Ti (15-3-3-3)), or αβ titanium alloy (such as, for example, Ti(6-4)). Preferably, the second plate 30 is disposed contiguous with the first plate 20 and the second plate 30 may be diffusion bonded to the first plate 20.

The present invention may also include a third plate 40 that also comprises a different material than the material comprising the first plate 20. The third plate 40 is disposed opposite the second plate 30. Like the second plate 30, this third plate 40 may be comprised, for example, of any traditional armor materials such as, for example, titanium, gamma phase titanium-aluminum, α titanium alloy (such as, for example, CPTi grades (1–4)), β titanium alloy (such as, for example, Ti(10-2-3) or Ti (15-3-3-3)), or αβ titanium alloy (such as, for example, Ti(6-4)). Also, the third plate 40 may be disposed contiguous with the first plate 20 and the third plate 40 may be diffusion bonded to the first plate 20.

The armor plate 10 of the present invention may be manufactured by providing a first plate 20 that comprises at least one energy absorption layer 22. As discussed earlier, the first plate 20 may comprise a single energy absorption layer 22 or it may comprise multiple energy absorption layers 22, 24, as shown in FIG. 1. Preferably, the first plate 20 comprises Nitinol, wherein the Nitinol may be multiple layers of different compositions with superelastic and SME compositions, as discussed earlier. The method of forming Nitinol plates is well known to those skilled in the art.

The first plate 20 is contacted to the second plate 30 and bonded thereto. The first plate 20 and the second plate 30 may be initially contacted by welding the first plate 20 on seams (or edges) to the second plate 30. Preferably, the contacting surfaces of the first plate 20 and the second plate 30 are cleaned, such as by grinding and pickling, before they are contacted.

Figure 2:
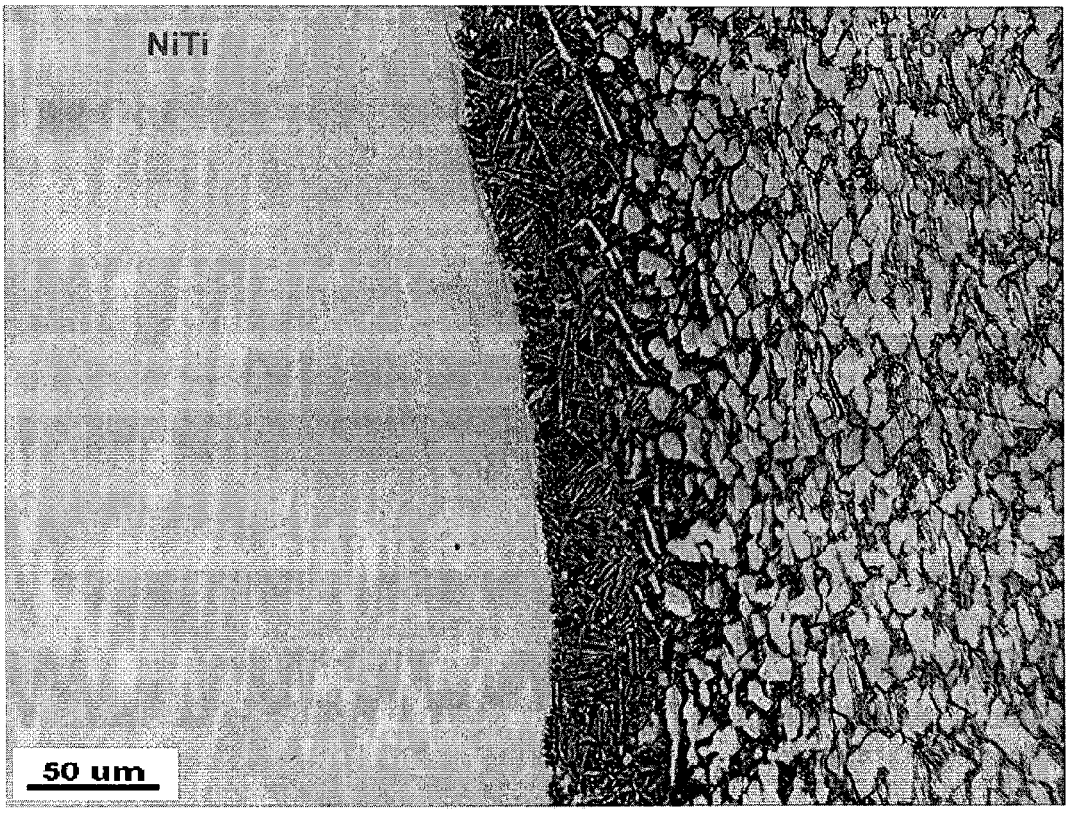
FIG. 2 is a photomicrograph illustrating the bond between plates in accordance with one embodiment of the lightweight armor of the present invention.

Referring now to FIG. 2, there is illustrated a photomicrograph of the bond between plates in accordance with one embodiment of the lightweight armor of the present invention. The bonding of the first plate 20 to the second plate 30 may be completed by heating the first plate 20 and the second plate 30 and applying bonding pressure, such as by rolling, HIP or explosive bonding, to the first plate 20 and the second plate 30 to provide a metallurgical bond. For example, when the first plate 20 comprises Nitinol and the second plate 30 comprises Ti(6-4), the plates may be rolled at below 1800° F. to achieve intimate contact between the first plate 20 and the second plate 30. The plates may then be heated to above 1830° F. to create a limited liquid phase (The bonding of Nitinol to Ti(6-4) is complicated by the existence of a low melting phase that forms at about 1830° F. Since the bonding temperature is above 1830° F., roll bonding creates a liquid phase that precludes successful processing.). The plates may then be cooled to below 1800° F. and rolled to affect a good metallurgical bond. The method of forming Ti(6-4) plates is well known to those skilled in the art.

A third plate 40 may also be provided. As shown in FIG. 1, the third plate 40 is also contacted to the first plate 20 and bonded thereto. When a third plate 40 is used, the third plate 40 may be welded to the second plate 30, such as in the area of the overhanging edges as is shown in FIG. 1. Preferably, the contacting surfaces of the first plate 20 and the third plate 40 are cleaned, such as by grinding and pickling, before they are contacted. The bonding of the first plate 20 to the third plate 40 may be completed by the same method described above for bonding the first plate 20 to the second plate 30.

In practice, several multiple layered armor plates 10 may be manufactured and stacked upon each other. In such an arrangement, an inert material that prevents a metallurgical bond from forming should separate the individual armor plates 10. Such coating or separation materials are well known to those skilled in the art and include BN, $TiO_2$ and MgO.

The thickness of each plate that comprises the armor plate 10 of the present invention is selected based on several factors including energy absorption requirements, cost, and weight. One measure of the effectiveness of armor plates is the average velocity ($V_{50}$) of a shell required to penetrate the armor plate. The present invention provides an armor plate with repeat hit capability and increased $V_{50}$ over conventional armor plates of similar weight.

It is to be understood that the present description illustrates aspects of the invention relevant to a clear understanding of the invention. Certain aspects of the invention that would be apparent to those of ordinary skill in the art and that, therefore, would not facilitate a better understanding of the invention may not have been presented in order to simplify the present description. Although the present invention has been described in connection with certain embodiments, those of ordinary skill in the art will, upon considering the foregoing description, recognize that many modifications and variations of the invention may be employed. For example, the present description of embodiments of the invention has referred to a multiple layer plate-shaped structure comprising a plurality of individual layers or plates. It will be understood that the present invention is not so limited and encompasses, for example, any armor structure including one or more of the energy absorbing material that may undergo a reversible phase change and/or experience elastic strain deformation of at least 5% when impacted by a projectile or other object imparting sufficient energy to the armor structure. The foregoing description and the following claims are intended to cover all such variations, modifications, and additional embodiments of the present invention.

I claim:

1. A ballistic armor capable of withstanding penetration by a projectile impacting the armor, the ballistic armor comprising:

a first energy absorbing plate consisting essentially of a metallic material, said metallic material being at least one of a metallic material that undergoes a reversible phase change upon absorbing energy and a metallic material that exhibits an elastic strain deformation of at least 5%; and a second plate of a metallic material that is contiguous with and metallurgically bonded to the first energy absorbing plate, wherein said second plate comprises a material selected from the group consisting of an α titanium alloy that is at least one of grades 1–4 CPTi, an αβ titanium alloy that is Ti(6-4), and a β titanium alloy that is at least one of Ti(10-2-3) or Ti(15-3-3-3): and the metallic material of said second plate is different from said metallic material of said first energy absorbing plate.

2. The ballistic armor of claim 1, wherein said metallic material that undergoes a reversible phase change upon absorbing energy undergoes a reversible endothermic phase change when heated to a predetermined temperature.

3. The ballistic armor of claim 2, wherein said predetermined temperature is at least −50° C. and is no greater than 200° C.

4. The ballistic armor of claim 3, wherein said first energy absorbing plate is selected from the group consisting of nickel-titanium alloys, copper-zinc alloys, and copper-aluminum-nickel-manganese alloys.

5. The ballistic armor of claim 4, wherein said first energy absorbing plate is an alloy consisting essentially of 45 up to 55 atomic percent nickel, 45 up to 55 atomic percent titanium, and incidental impurities.

6. The ballistic armor of claim 5, wherein said first energy absorbing plate is Nitinol.

7. The ballistic armor of claim 1, wherein said second plate is diffusion bonded to said first energy absorbing plate.

8. The ballistic armor of claim 1, further comprising a third plate disposed opposite said second plate and comprised of a material that differs from said metallic material of said first energy absorbing plate, said third plate being contiguous with and metallurgically bonded to at least a portion of said first energy absorbing plate.

9. The ballistic armor of claim 8, wherein said third plate comprises a material selected from the group consisting of titanium, gamma phase titanium-aluminum, α titanium alloy, β titanium alloy, and αβ titanium alloy.

10. The ballistic armor of claim 1, wherein said first energy absorbing plate consists essentially of 45 up to 55 atomic percent nickel, 45 up to 55 atomic percent titanium, and incidental impurities.

11. The ballistic armor of claim 10, further comprising a third plate disposed opposite said second plate and comprising a material that differs from said first energy absorbing plate.

12. The ballistic armor of claim 11, wherein said third plate comprises a material selected from the group consisting of titanium, gamma phase titanium-aluminum, α titanium alloy, β titanium alloy, and αβ titanium alloy.

13. The ballistic armor of claim 11, wherein said first energy absorbing plate is contiguous with said third plate.

* * * * *